US005135841A

United States Patent [19]

Wernicke et al.

[11] Patent Number: 5,135,841

[45] Date of Patent: Aug. 4, 1992

[54] PROCESS FOR THE PRODUCTION OF COLOR PHOTOGRAPHIC COPIES

[75] Inventors: Ubbo Wernicke, Cologne; Herbert Mitzinger, Lindlar; Udo Quilitzsch, Leichlingen, all of Fed. Rep. of Germany

[73] Assignee: Agfa Gevaert Aktiengesellschaft, Leverkusen, Fed. Rep. of Germany

[21] Appl. No.: 534,522

[22] Filed: Jun. 6, 1990

[30] Foreign Application Priority Data

Jun. 20, 1989 [DE] Fed. Rep. of Germany ..... 3920084

[51] Int. Cl.[5] ..... G03C 7/46

[52] U.S. Cl. ..... 430/494; 430/357; 430/358; 430/359; 430/367; 430/379; 430/30

[58] Field of Search ..... 430/357, 358, 359, 379, 430/494, 30, 367

[56] References Cited

U.S. PATENT DOCUMENTS

| | | | |
|---|---|---|---|
| 4,021,831 | 5/1977 | Bercher | 354/295 |
| 4,440,851 | 4/1981 | Tosaka et al. | 430/494 |
| 4,619,889 | 10/1986 | Yuyama et al. | 430/494 |
| 4,904,573 | 11/1988 | Hara | 430/30 |

FOREIGN PATENT DOCUMENTS

| | | | |
|---|---|---|---|
| 0364845 | 3/1979 | European Pat. Off. . | |
| 56-0137350 | 10/1981 | Japan | 430/357 |

*Primary Examiner*—Charles L. Bowers, Jr
*Assistant Examiner*—Thomas R. Neville
*Attorney, Agent, or Firm*—Connolly and Hutz

[57] ABSTRACT

Colored copies of outstanding quality are obtained from half tone originals by means of a color paper of extremely hard gradation if the silver halide emulsions of the color paper consists substantially of silver chloride and if, before the material is processed, a filtered, homogeneous exposure is carried out, extending from subthreshold pre-exposure to an exposure which reduces the maximum color densities by 0.4 density units.

4 Claims, 1 Drawing Sheet

PROCESS FOR THE PRODUCTION OF COLOR PHOTOGRAPHIC COPIES

Figure 1:
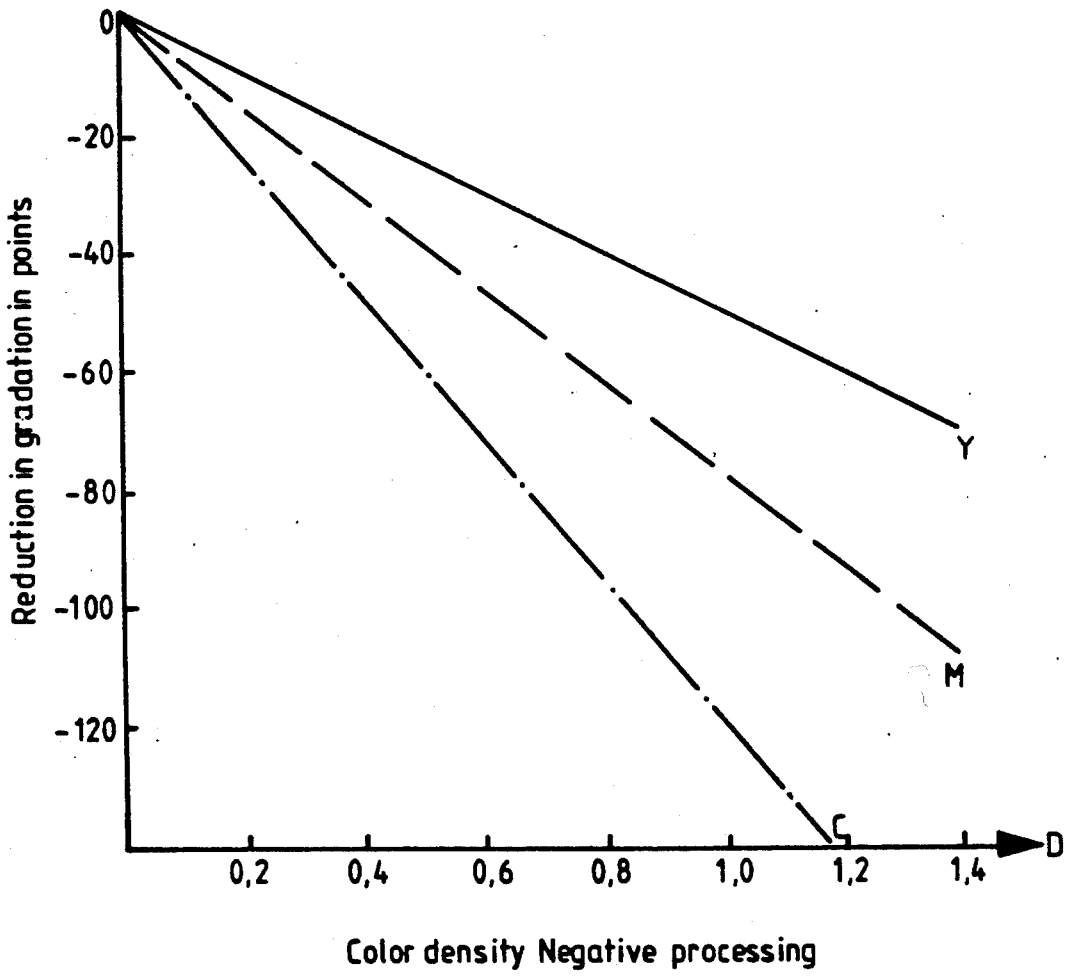

This invention relates to a process for the production of coloured copies of half tone originals using a colour paper of extremely hard gradation and a process for the production of coloured copies starting from selectively positive coloured line and half tone originals using a single type of colour paper.

The copying of coloured line originals normally requires colour papers of very hard gradation while half tone originals require colour papers of low gradation.

Further, over-exposed, low contrast slide originals require a copying material of hard gradation whereas high contrast, under-exposed slide originals require a copying material of soft gradation.

Sub-dividing a complete copying order, for example for 100 slides, over several apparatus employing different copying materials is problematic and time consuming.

On the other hand, constantly changing the copying material in one and the same machine always entails expensive loss of material.

Further, image to image copying, for example, requires a hard copying material because poor copies would otherwise be produced on conventional colour reversal paper.

Colour reversal paper of hard gradation should have gamma values about 20% higher than colour reversal paper of normal gradation. Partially a color paper with extremely hard gradation according to the invention has a G 2 of ≧150.

It was an object of the present invention to modify the method of processing so that colour copies of acceptable quality would be obtainable from half tone originals even when using colour paper of very hard gradation and so that colour copies of acceptable quality would be obtainable both from contrast free and from high contrast originals, in particular dia originals, in a single machine, using a single colour paper.

The problem is solved if the colour paper of very hard gradation used contains silver halide emulsions consisting substantially of silver chloride and, surprinsingly, if the gradation values (gamma 2) can be lowered by about 25% without a drastic reduction in the maximum densities (only by about 10%), this being achieved by carrying out a filtered, homogeneous exposure in addition to the imagewise exposure.

The homogeneous exposure may be carried out before, during or after the imagewise exposure but must be carried out before the first development.

The homogeneous exposure is carried out with a quantity of light extending from sub-threshold pre-exposure to an exposure which reduces the maximum colour densities by 0.4 density units.

The quantity of light required for a given exposure apparatus and for the particular type of extremely hard colour paper used can easily be determined by simple preliminary tests. Thereafter, it is automatically adjusted, preferably by the printing apparatus which previously measures the contrast of the original. This at the same time solves the second problem since in the case of low contrast originals the printing apparatus does not carry out the homogeneous pre-exposure. It would appear advantageous to carry out the pre-exposure immediately before the paper runs into the development machine. The source of light used for this exposure should be adjustable in colour and brightness. Homogeneous distribution over the width of the paper may be achieved by using a light slot, glass fibres, photo conductive plastics or electric bulbs with reflector. Preferably at least three bulbs are used with individual blue, green, red filtering and with an individual control of the brightness through electric resistance. The homogeneous exposure may be carried out simultaneously with the main exposure; this has the additional advantage that when integral light metering is carried out, the quantity of light for the main exposure is reduced by the quantity of light for the homogeneous pre-exposure.

The process carried out after exposure is composed of the following steps:

First development (black and white negative development)

The silver halide which has been exposed imagewise is developed by a first developer to form a black and white negative. Metol hydroquinone or phenidone hydroquinone developers are generally used.

Rinsing

Removal of the first developer to prevent after-development in the colour development bath.

Diffuse second exposure or chemical fogging

Any silver halide not developed in the first developer is rendered developable.

Colour development

Silver halide which has been activated by the second exposure or by chemical fogging is developed into silver, and dye formation takes place.

The dyes are produced from the colour coupler and the developer oxidation product in a quantity proportional to the amount of silver halide reduced in the colour developer.

Bleaching and fixing or bleach fixing

Dissolving of all the silver formed by first development and colour development to leave a positive dye image.

The intermediate step of rinsing may be shortened or completely omitted if first development is carried out with a colour developer and dye formation is prevented, e.g. by the addition of a sulphite, ascorbic acid, citrazinic acid or a white coupler.

The colour developer substances suitable for the process according to the invention correspond to the following general formula (I)

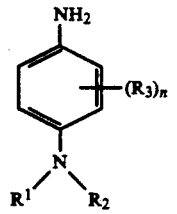

(I)

wherein $R_1$ and $R_2$ denote optionally substituted $C_1$ to $C_4$ alkyl, $C_6$ to $C_{10}$ aryl or $C_1$ to $C_3$ alkoxy, $R_3$ denotes H or optionally substituted $C_1$ to $C_4$ alkyl, $C_6$ to $C_{10}$ aryl, $C_1$ to $C_3$ alkoxy or halogen, and n stands for 1 or 2.

The following are examples of such compounds: N,N-diethyl-p-phenylene diamine hydrochloride, 4-N,N-diethyl-2-methyl-phenylene diamine hydrochloride, 4-(N-ethyl-N-2-methane-sulphonylaminoethyl)-2-methyl-phenylene diamine-sesquisulphate monohydrate, 4-(N-ethyl-N-2-hydroxyethyl)-2-methyl-phenylene diaminosulphate and 4-N,N-diethyl-2,2'-methanesulphonylamino-ethyl phenylene diamine hydrochloride.

The silver halide emulsions in the preferred material for the process according to the invention contain at least 80 mol % of AgCl, in particular at least 95 mol % of AgCl, from 0 to 20 mol % of AgBr, in particular from 0 to 5 mol % of AgBr, and from 0 to 2 mol % of AgI. The emulsions are preferably free from iodide.

The halides may be predominantly in the form of compact crystals which may, for example, be regular cubes or octahedrons or they may have transitional forms. The emulsions may also advantageously contain platelet shaped crystals with an average ratio of diameter to thickness of preferably at least 5:1, the diameter of a grain being defined as the diameter of a circle having a surface area equal to the projected surface area of the grain. The layers may also contain tabular silver halide crystals in which the ratio of diameter to thickness is substantially greater than 5:1, e.g. from 12:1 to 30:1.

The silver halide grains may also have a multi-layered grain structure, in the simplest case consisting of an inner and an outer region (core/shell) which may differ from one another in their halide composition and/or by other modifications such as doping of the individual grain regions. The average grain size of the emulsions is preferably from 0.2 μm to 2.0 μm and the grain size distribution may be either homodisperse of heterodisperse. Homodisperse grain size distribution means that 95% of the grains deviate by not more than ±30% from the average grain size.

The material to be processed according to the invention contains at least one blue sensitive silver halide emulsion layer with which at least one yellow coupler is associated, at least one red sensitive layer with which at least one cyan coupler is associated and at least one green sensitive layer with which at least one magenta coupler is associated.

The layer arrangements may consist of support, blue sensitive layer(s), green sensitive layer(s) and red sensitive layer(s) or of support, red sensitive layer(s), green sensitive layer(s) and blue sensitive layer(s). In the second layer arrangement, a yellow filter layer may be arranged between the blue sensitive and the green sensitive layers, if necessary. The material also contains the usual interlayers and protective layers.

EXAMPLES

EXAMPLE 1

A colour photographic recording material having the following arrangement of layers was used. The quantities given are based in each case on 1 $m^2$. The quantities of silver halide applied are given in terms of the corresponding quantities of $AgNO_3$. The support used was paper coated with polyethylene on both sides.

Layer arrangement 1:

First layer (substrate layer):

0.2 g of gelatine

Second layer (blue sensitive layer):

blue sensitive silver halide emulsion (99.5 mol % of chloride, 0.5 mol % of bromide, average grain diameter 0.8 μm) of 0.63 g of $AgNO_3$ containing 1.38 g of gelatine, 0.95 g of yellow coupler Y, 0.2 g of white coupler W and 0.29 g of tricresyl phosphate (TCP).

Third layer (protective layer)

1.1 g of gelatine, 0.06 g of 2,5-dioctyl hydroquinone and 0.06 g of dibutyl phthalate (DBP).

Fourth layer (green sensitive layer)

Green sensitized silver halide emulsion (99.5 mol % chloride, 0.5 mol % bromide, average grain diameter 0.6 μm) of 0.45 g of $AgNO_3$ containing 1.08 g of gelatine, 0.41 g of magenta coupler M, 0.08 g of 2,5-dioctyl hydroquinone, 0.34 g of DBP and 0.04 g of TCP.

Fifth layer (UV protective layer)

1.15 g of gelatine, 0.6 g of UV absorbent corresponding to the following formula

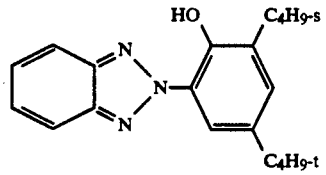

0.045 g of 2,5-dioctyl hydroquinone and 0.04 g of TCP.

Sixth layer (red sensitive layer)

Red sensitized silver halide emulsion (99.5 mol % chloride, 0.5 mol % bromide, average grain diameter 0.5 μm) of 0.3 g of $AgNO_3$ containing 0.75 g of gelatine, 0.36 g of cyan coupler C and 0.36 g of TCP.

Seventh layer (UV protective layer)

0.35 g of gelatine, 0.15 g of the UV absorbent of the fifth layer and 0.2 g of TCP.

Eighth layer (protective layer)

0.9 g of gelatine and 0.3 g of hardener corresponding to the following

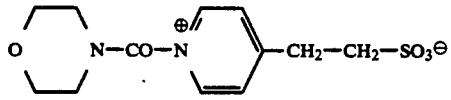

The components used correspond to the following formulae:

Y

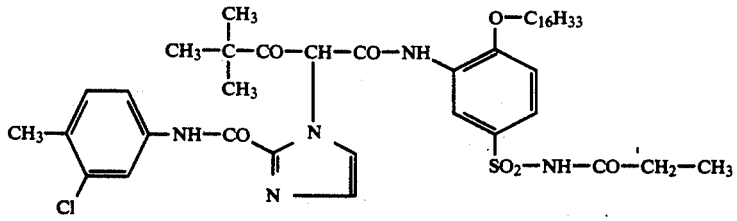

M

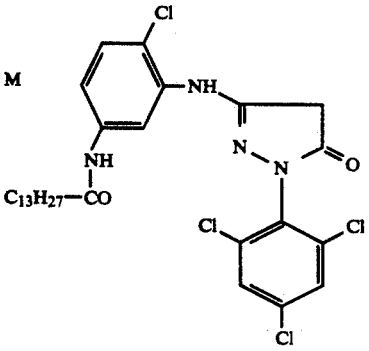

C

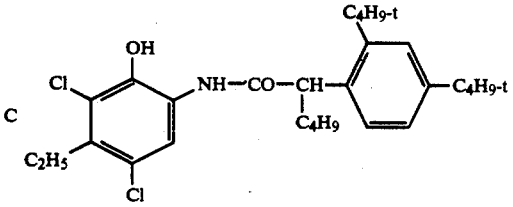

W

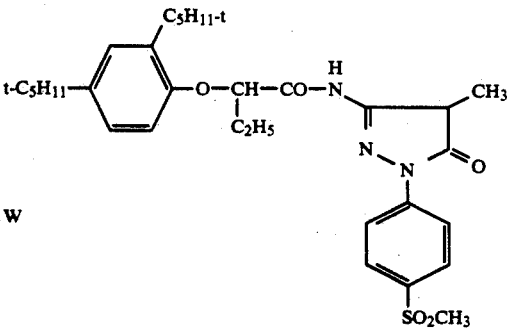

The material is exposed imagewise behind a grey step wedge and processed as follows:

| | | |
|---|---|---|
| First development | 60 sec | 36° C. |
| Washing | 120 sec | 22° C. |
| Diffuse second exposure | 10 sec | |
| Second development | 60 sec | 36° C. |
| Washing | 30 sec | 22° C. |
| Bleach fixing bath | 90 sec | 36° C. |
| Washing | 120 sec | 22° C. |
| Drying | | |

The processing baths have the following composition:

| First developer | |
|---|---|
| Water | 900 ml |
| EDTA | 2 g |
| HEDP, 60% by weight | 0.5 ml |
| Sodium sulphite | 7 g |
| Sodium chloride | 2 g |
| Hydroquinone sulphonic acid, potassium salt | 15 g |

-continued

| First developer | |
|---|---|
| 1-phenyl-pyrazolidone-3 (phenidone) | 0.3 g |
| Potassium carbonate | 10 g |

pH adjustment to pH 9 with KOH or $H_2SO_4$, made up with water to 1 liter.

| Second developer | |
|---|---|
| Water | 900 ml |
| EDTA | 2 g |
| HEDP, 60% by weight | 0.5 ml |
| Sodium chloride | 1 g |
| N,N-diethylhyroxylamine, 85% by weight | 5 ml |
| 4-(N-ethyl-N-2-methanesulphonylamino-ethyl)-2-methylphenylene diamine sesquisulphate monohydrate (CD 3), 50% by weight | 8 ml |
| Potassium carbonate | 25 g |

pH adjustment to pH 10 with KOH or $H_2SO_4$; made up with water to 1 liter.

| Bleach fixing bath | |
|---|---|
| Water | 800 ml |
| EDTA | 4 g |
| Ammonium thiosulphate | 100 g |
| Sodium sulphite | 15 g |
| Ammonium-iron-EDTA complex | 60 g |
| 3-mercapto-1,2,4-triazole | 2 g |

pH adjustment to pH 7.3 with ammonia or acetic acid; made up with water to 1 liter.

The results are shown in the following table.

EXAMPLE 2

The same procedure as in Example 1 is employed but in addition a homogeneous exposure, i.e. exposure which is not imagewise is carried out before the first development.

Determination of necessary quantity of light and the method of filtration used for this homogeneous exposure are as follows:

The quantity of light for the homogeneous pre-exposure should produce colour densities of x density units above minimum densities on the colour paper used if the colour paper ist subjected only to colour development and bleach fixing+washing without black and white first development.

Filtration of the light for homogeneous pre-exposure should be carried out in such a manner that the three colour layers do not necessarily develop the same density units above minimum density (i.e. $x \neq y \neq z$), as explained below:

For example:

a) colour development and bleach fixing+washing of unexposed colour paper produces a minimum density of
Y: 0.12; M: 0.11; C: 0.09 b) colour development and bleach fixing+washing colour paper with pre-exposure controlled as to filtration and quantity of light ($x \neq y \neq z$) produces colour densities of
Y: 0.80; M: 0.60; C: 0.40

The same pre-exposure used with the reversal process leads to a uniform reduction in gamma value by about 20%.

EXAMPLE 3

In this system, the colours of the shadows can also be selectively controlled by a special filtration of the light for homogeneous exposure, whereby compensation can be obtained for any unwanted cross curves present in the original.

For this purpose, the light for homogeneous exposure is filtered in such a manner that the densities given in Example 2b) attain approximately the following values:

| | Y | M | C |
|---|---|---|---|
| a) | 0.80 | 0.60 | 0.14 for cyan shadows |
| b) | 0.80 | 0.60 | 0.40 for neutral shadows |
| c) | 0.80 | 0.60 | 0.80 for intensely red shadows. |

Analogous procedures are adopted for other shadow adjustments.

Increasing the duration of filtered pre-exposure increases the colour densities obtained from colour development and bleach fixing according to 2b), with the result that the effect on the reduction in gradation with complete reversal development is enhanced, see FIG. 1.

The results are most clearly characterised by the gradation values (gamma 2) and the maximum densities.

| | | Gamma 2 | | | Maximum Densities | | |
|---|---|---|---|---|---|---|---|
| Example | | Y | M | C | Y | M | C |
| 1 | | 212 | 212 | 224 | 253 | 265 | 258 |
| 2 | | 170 | 170 | 165 | 232 | 243 | 244 |
| 3 | a | 172 | 174 | 210 | 240 | 251 | 259 |
| | b | 170 | 170 | 165 | 232 | 243 | 244 |
| | c | 172 | 170 | 131 | 235 | 242 | 209 |

We claim:

1. A process of producing colored copies of half tone originals by imagewise exposure of hard gradation color paper
which includes the steps of
a filtered homogeneous exposure of a color paper of hard gradation
in which the silver halide emulsions consist substantially of silver chloride,
said filtered homogeneous exposure extending from sub-threshold pre-exposure to an exposure which reduces the maximum color densities by 0.4 density units, and
subsequent processing of said color paper.

2. Process according to claim 1, characterised in that the silver halide emulsions contain at least 80 mol % of AgCl, from 0 to 20 mol % AgBr and from 0 to 2 mol % of AgI.

3. Process according to claim 1, characterised in that the silver halide emulsions contain at least 95 mol % of AgCl and from 0 to 5 mol % of AgBr.

4. Process according to claim 1, characterised in that said processing step consists of the steps of first development, rinsing, diffuse second exposure or chemical fogging, colour development, and bleaching and fixing or bleach fixing.

* * * * *